US005094694A

United States Patent [19]

LaBrie et al.

[11] Patent Number: 5,094,694

[45] Date of Patent: Mar. 10, 1992

[54] PROCESS FOR DEMINERALIZING A SUGAR-CONTAINING SOLUTION

[75] Inventors: Robert L. LaBrie; Upen J. Bharwada, both of Midland, Mich.

[73] Assignee: The Dow Chemical Company, Midland, Mich.

[21] Appl. No.: 668,395

[22] Filed: Mar. 13, 1991

Related U.S. Application Data

[63] Continuation of Ser. No. 183,417, Apr. 18, 1988, abandoned, which is a continuation-in-part of Ser. No. 32,847, Mar. 31, 1987, abandoned.

[51] Int. Cl.[5] ..... C13D 3/14

[52] U.S. Cl. ..... 127/46.2; 426/271; 210/660; 210/670

[58] Field of Search ..... 127/46.2, 46.1, 46.3; 426/271; 210/670, 660

[56] References Cited

U.S. PATENT DOCUMENTS 3,928,193 12/1975 Melaja et al. .

4,523,960 6/1985 Otte ..... 127/46.2

4,543,261 9/1985 Harmon et al. ..... 210/669

OTHER PUBLICATIONS

Frederick J. Dechow, Separation and Purification Techniques in Biotechnology, Noyes Publications, pp. 357–358.

1990 Annual Book of ASTM Standards, Section 11, vol. 11.02, Water (II), p. 720.

*Ion Exchange Resins,* Kunin, Robert E. Krieger publishing company, Huntington, N.Y., 1972, pp. 321–322.

*Ion Exchangers: Properties and Application,* Dorfner, Ann Arbor Science Publisher Inc., 1972, pp. 28–32.

*Primary Examiner*—Theodore Morris

*Assistant Examiner*—David M. Brunsman

[57] ABSTRACT

Improved method for demineralizing a sugar-containing solution using an ion exchange resin in bead form wherein the volume average bead diameter is from 400 to 700 μm and the bead diameter distribution is such that at least 80 volume percent of the beads have diameters which fall within a range of ±15 percent of the volume average diameter of the resin used.

7 Claims, No Drawings

PROCESS FOR DEMINERALIZING A SUGAR-CONTAINING SOLUTION

CROSS-REFERENCE TO RELATED APPLICATION

This is a continuation of application Ser. No. 07/183,417, filed Apr. 18, 1988 now abandoned, which is a continuation-in-part of copending application Ser. No. 032,847, filed Mar. 31, 1987, now abandoned.

BACKGROUND OF THE INVENTION

This invention relates to an improved process for removing ionic impurities from a sugar-containing solution, especially a high fructose corn syrup, by contacting the solution with specific ion exchange resins.

The preparation of a sugar-containing solution requires the removal of various impurities from the process streams. The main impurities in sugar are measured as sulphated ash which contains cations and anions such as $Ca^{++}$, $Mg^{++}$, $Na^{+}$, $K^{+}$, $SO_3^{--}$, $Cl^{-}$, $SO_4^{--}$ and the like. For the production of a refined sugar-containing solution, it is necessary to remove these impurities. This is achieved by a demineralization process. It is standard practice in the demineralization process to pass the sugar solution first through a strongly acidic cation exchange resin in the hydrogen form, followed by passage through a strongly basic anion exchanger and/or weakly basic anion exchanger in the hydroxide or free base form. Once the ion exchange resins become nearly exhausted, it becomes necessary to regenerate their ion exchanging capacity. Prior to contacting the ion exchange resin with the regenerating agent, it is necessary to remove essentially all of the sugar solution from the resin bed. This is accomplished by passing effective quantities of water over the resin in order to "sweeten-off" the sugar solution within the resin bed. The resulting effluent is known in the industry as sweet-water.

The "sweetening-off" water or "sweet-water" after having sweetened-off the sugar from the resin contains an amount of recoverable sugar. The sweet-water is desirably recycled back as a dilution medium to other process steps (i.e., high fructose corn syrup saccharification). Typically, there is substantially more sweet-water generated than can be utilized for dilution purposes. Also, the sweet-water composition limits the usefulness of the sweet-water as a dilution source (e.g., high fructose sweet-water is not added back to the dextrose solution at the saccharification step). The excess sweet-water normally requires concentrating during some step in the refining process. This is accomplished by removing a substantial portion of the water without removing any of the sugar which has been washed off of the resin. This is generally accomplished by evaporating off an amount of water which results in a desired dissolved solids content, i.e., sugar content, in the unevaporated sweet-water.

The evaporation of the water is an expensive unit operation in the process for preparing refined sugars. Therefore, it is desirable to reduce the expense incurred during the evaporation operation of the process without detrimentally affecting the quality of sugar which is produced by the process. It is also desirable to increase the operating capacity of the resins for demineralizing a sugar-containing solution.

SUMMARY OF THE INVENTION

The invention is an improved process for demineralizing a sugar-containing solution. The improvement comprises using an ion exchange resin in bead form wherein the volume average diameter of the beads is from 400 to 700 μm and which resin exhibits a bead diameter distribution such that at least 80 volume percent of the beads have diameters which fall within a range of ±15 percent of the volume average diameter of the resin used.

The resin of the improved process has a smaller volume average bead diameter and a narrower bead size distribution relative to conventional resins used for demineralizing sugar-containing solutions. The smaller mean diameter of the beads shortens the average diffusion distance traveled by exchanging components within the beads. Therefore, the operating capacity of the resin for demineralizing a sugar-containing solution is increased and the volume of water required to sweeten-off sugar from the resin is decreased. However, beads with a mean diameter below 400 μm will create unacceptably high pressure drops within a resin-containing column and would therefore limit operating capacity. Since the resin used in this invention has a narrow bead size distribution, the volume percent of beads having a bead diameter less than 400 μm is insignificant and would not adversely affect the operating characteristics of the resin.

DETAILED DESCRIPTION OF THE INVENTION

Macroporous ion exchange resins which are capable of removing ionic impurities from sugar-containing solutions may be of the anion exchange variety or of the cation exchange variety or of the type resin which contains both anion exchange sites and cation exchange sites.

Macroporous ion exchange resins which are available commercially may be employed, such as those which have been offered commercially under the tradenames DOWEX TM, AMBERLITE TM, DUOLITE TM, and others.

The cation exchange resins are those capable of exchanging cations. This capability is provided by resins having functional pendant acid groups on the polymer chain, such as carboxylic and/or sulfonic groups. The anion exchange resins are those capable of exchanging anions. This capability is provided by resins having functional pendant base groups on the polymer chain, such as ammonium or amine groups. Resins having both types of exchange groups are also within the purview of the present invention.

Examples of macroporous strong-acid exchange resins include the sulfonated styrene-divinylbenzene copolymers such as are offered commercially under the tradenames DOWEX TM 88, DOWEX TM MSC-1, DUOLITE TM C-280, AMBERLITE TM 200, and KASTEL TM C301.

Acid resins of intermediate strength have also been reported, such as those containing functional phosphonic or arsonic groups.

Macroporous weak-acid resins include those having functional groups of, e.g., phenolic, phosphonous, or carboxylic types. Some common weak-acid resins are those derived by crosslinking of acrylic, methacrylic or maleic acid groups by use of a crosslinking agent such as ethylene dimethacrylate or divinylbenzene. DUOLI- TE TM C-464 is a tradename applied to a resin having such functional carboxylic groups.

Among the macroporous strong-base resins are those which, notably, contain quaternary ammonium groups pendant from a poly(styrene-divinylbenzene) matrix. DOWEX TM MSA-1 and DUOLITE TM A-191 are tradenames of strong-base resins reported as having amine functionality derived from trimethylamine. DOWEX TM MSA-2 is a tradename of a macroporous strong-base resin reported as having amine functionality derived from dimethylethanolamine.

Macroporous weak-base anion exchange resins generally contain functional groups derived from primary, secondary, or tertiary amines or mixtures of these. Functional amine groups are derived from condensation resins of aliphatic polyamines with formaldehyde or with alkyl dihalides or with epichlorohydrin, such as those available under the tradenames DOWEX TM WGR and DOWEX TM WGR-2.

Other macroporous weak-base resins are prepared by reaction of an amine or polyamine with chloromethylated styrene-divinylbenzene copolymer beads, such as DOWEX TM MWA-1, DOWEX TM 66, and DUOLITE TM A-392S.

The above-described resins may be used as ion exchange resins in the demineralization of sugar-containing solutions. Sugar solutions usually contain ionic impurities such as $Ca^{++}$, $Mg^{++}$, $Na^{+}$, $K^{+}$, $SO_3^{--}$, $SO_4^{--}$, $Cl^{-}$ and the like. The removal of such impurities is essential to the preparation of marketable sugar products.

Examples of sugar-containing solutions include aqueous solutions of cane and beet sugar, high fructose corn syrups, high fructose syrups derived from inulin, tapioca and potato starches, maple sugar, palm sugar, sorghum derived sugar, and the like, the most preferred being solutions of high fructose corn syrup. The disclosed sugar solutions which may be effectively demineralized exhibit dissolved solids, i.e., sugar content, ranging from 20 percent to 60 percent.

An effective demineralization may be accomplished by using a strongly acidic cation exchange resin in the hydrogen form, followed by an anion exchange resin preferably in the hydroxide or free base form. The sugar solution to be demineralized may be contacted with the resin by any conventional means which results in intimate contact between the resin and the sugar solution. Such methods include batch vessels, packed columns, fluidized beds and the like. The contacting may be of a batch, semi-continuous or continuous nature. Preferably the sugar solution and the resins are contacted continuously in an ion exchange column.

The resins and the sugar solution are effectively contacted for a period of time sufficient to remove a substantial portion of the ionic impurities. The contact time is largely dependent on the type of vessel used to contact the resin and the sugar solution, the amount of resin used, the pH of the sugar solution, the temperature, the level of demineralization desired, and the like. The resin may be used until the ion exchange capacity of the resin becomes nearly exhausted as evidenced by an increase in the mineral content of the sugar solution after having been treated with the resin. At this time it becomes necessary to regenerate the ion exchange capacity of the resin in order to prepare it for reuse.

The regeneration of the demineralizing resins involves the steps of (1) "sweetening-off" the sugar solution from the resin, (2) backwashing the resin to remove impurities, (3) contacting the resin with an appropriate regenerant solution in an amount effective to regenerate the ion exchange capacity, and then (4) rinsing the resin to remove any of the excess regenerant. The resin is then ready to be reused as a demineralizing resin and may be contacted with the sugar solution to be demineralized.

The step of "sweetening-off" the sugar solution from the resin involves the washing of the resin with water in order to remove essentially all of the sugar from the ion exchange resins. This is accomplished by contacting the ion exchange resin which has been sweetened-on with an amount of water effective to wash substantially all of the sugar solution from the ion exchange resin. The resin and water are contacted until essentially only water is coming off of the resin bed. The sweetening-off is considered complete when there is essentially no sugar in the effluent sweet-water stream.

The sweet-water, which results from the sweetening-off of the sugar from the resin, contains an amount of sugar which may go to waste if not recovered within the system. It is desirable to recover this sugar in as economical a way as possible. Recovery of this sugar may be accomplished by recycling the sweet-water stream back into the sugar-containing solution of the main process stream. Some of the sweet-water stream may be needed for dilution purposes elsewhere in the main sugar process stream. However, most of the sweet-water volume is returned to the main sugar process stream as an unwanted dilution medium. This excess dilution water is removed in preparing the sugar solution for further processing (i.e., increasing the dissolved solids level in preparation for crystallization and/or storage of the sugar solution). The removal of the excess dilution water may be accomplished by evaporating off some of the water from the sugar-containing solution. This evaporation results in an effective increase in the level of dissolved solids present in the process streams.

It has been discovered that by using ion exchange resins which exhibit bead diameters which fall within a specific size distribution, the operating capacity of the resins for demineralizing sugar-containing solutions can be increased and the amount of water which must be used to sweeten-off the sugar solution from the demineralizing resins may be appreciably decreased, thus also decreasing the amount of recycled dilution water which must be evaporated from the diluted main process stream in order to achieve the desired dissolved solids level. By increasing operating capacity and reducing the amount of water which must be evaporated off, the production costs of the sugar refining process may be reduced.

The size distribution of the beads employed in this invention is such that at least about 80 volume percent, more preferably at least about 85 volume percent, and most preferably at least about 90 volume percent of the beads exhibit a bead diameter which falls within a range of about $\pm 15$ percent, preferably within a range of $\pm 10$ percent, of the volume average diameter of the ion exchange resin used. Volume average diameter is determined by the following sequential steps: (1) measuring the diameter of each bead in a population of beads, (2) calculating the volume percent of beads within preset ranges of bead diameters to determine a bead diameter distribution (determined by dividing the volume of beads within a preset range of bead diameters by the total volume of beads in the population), and (3) calculating the mean from the bead diameter distribution obtained. The volume average diameter which may be used ranges from 400 μm to 700 μm, and more preferably from 500 μm to 600 μm, and most preferably from 525 μm to 575 μm.

The following examples are intended to illustrate the invention. All parts and percentages are by weight unless otherwise indicated.

EXAMPLE 1

700 mls of a macroporous strong acid cation exchange resin (available as DOWEX TM 88 from The Dow Chemical Company) which had been screened to the following bead size distribution[1]:

[1]Each of the bead size distributions illustrated in these examples is determined by a particle size analyzer sold commercially by the HIAC Division of Pacific Scientific Company as Model PC-320

| Bead Diameter Range (μm) | | Volume % Resin of Invention |
|---|---|---|
| Min. | Max. | Example 1 |
| 150 | 300 | 0.1 |
| 300 | 440 | 1.7 |
| 440 | 495 | 7.0 |
| 495 | 505 | 9.2 |
| 505 | 520 | 11.7 |
| 520 | 540 | 17.6 |
| 540 | 555 | 17.2 |
| 555 | 575 | 17.1 |
| 575 | 590 | 9.5 |
| 590 | 620 | 6.4 |
| 620 | 707 | 2.4 |
| 707 | 2500 | 0.0 |
| AVERAGE DIAMETER (VOLUME MEAN): 540 | | |
| DIAMETER DISTRIBUTION: 95.7% ± 15% of mean | | |

was loaded into a 1 in. I.D. glass column system consisting of two 2 ft., water jacketed sections, coupled together. A third unjacketed 2 ft. long section is attached on top of the two 2 ft. columns to allow backwashing of the resin. The resin is used in the sodium form.

The bed of resin is backwashed with deionized (D.I.) water at room temperature at a flow rate sufficient to expand the bed by 50 percent of the settled height. This is done in order to remove any unwanted matter present in the bed and also to classify the beads by size. The backwashing is continued for about 30 minutes.

The resin is then converted to the hydrogen form by pumping a minimum of 2 bed volumes of 2N hydrochloric acid through the bed for a minimum of 1 hour contact time. After converting the resin to the hydrogen form the resin is rinsed with a flow of D.I. water until the effluent water exhibits a pH of at least 5.

After the backwashing is accomplished the top unjacketed 61 cm portion of the column is removed and the column is capped with a glass fritted flow distributor.

One liter of degassed D.I. water is pumped downflow while the jacketed columns are being heated to a temperature of about 50° C. by circulating hot water through the column jackets.

One liter of refined 42 percent high fructose corn syrup (HFCS) exhibiting a dissolved solids (D.S.), i.e., sugar content, of 50 percent is passed downflow through the bed with a contact time of 60 minutes. Next, 1 liter of refined 42 percent HFCS, containing 117 g of sodium chloride, is passed downflow through the bed over a period of time effective to exhaust the resin to the sodium form, generally about 60 minutes. The HFCS containing the sodium chloride is followed by 1 liter of refined 42 percent HFCS passed downflow through the resin bed for a period of 30 minutes. The resin bed is sweetened-off by passing degassed D.I. water downflow at 2 bed volumes/hr. During the sweetening-off process, the flow out of the column is monitored and samples of the effluent are collected at recorded intervals in a fraction collector. Each sample is analyzed for refractive index by using an Abbe Mark II refractometer and the D.S. content is determined from industry standards based on the refractive indices. The results are reported in Table 1 under Example 1.

A plot of the D.S. concentrations versus the volume of water used to sweeten-off the sugar solution from the resin bed may be made and the areas under the curves integrated by known means. The integration results give a measure of the total amount of dissolved solids in the collected samples. From this value can be calculated the amount of water which must be removed from the total volume of liquid collected in order to return the collected sample to the original D.S. level of the 42 percent HFCS. This value is then used for comparison purposes to illustrate how much water must be evaporated from the sweet-water when an ion exchange resin which does not exhibit a uniform size distribution is used.

The results are summarized in Table 3 under Example 1.

COMPARATIVE EXAMPLE 1

The method of Example 1 was essentially repeated except that the strong acid cation exchange resin (available as DOWEX TM 88 from The Dow Chemical Company) used to demineralize the HFCS had the following bead size distribution:

| Bead Diameter Range (μm) | | Volume % Example C-1 |
|---|---|---|
| Min. | Max. | DOWEX TM 88 |
| 150 | 250 | 0.0 |
| 250 | 297 | 0.0 |
| 297 | 354 | 0.1 |
| 354 | 420 | 1.0 |
| 420 | 500 | 2.5 |
| 500 | 595 | 6.1 |
| 595 | 707 | 14.0 |
| 707 | 841 | 28.4 |
| 841 | 1000 | 36.2 |
| 1000 | 1190 | 11.7 |
| 1190 | 2000 | 0.0 |
| 2000 | 2500 | 0.0 |
| AVERAGE DIAMETER (VOLUME MEAN): 820 μm | | |
| DIAMETER DISTRIBUTION: 78.6% ± 15% of mean | | |

The results are summarized in Tables 1 and 3 under Example C-1.

TABLE I

| Cation Resin | | | |
|---|---|---|---|
| Example 1 | | Comparative Example C-1* | |
| Volume of Sweet-Water (ml) | Grams D.S./100 ml | Volume of Sweet-Water (ml) | Grams D.S./100 ml |
| 299 | 62.06 | 274 | 63.04 |
| 324 | 58.71 | 299 | 60.71 |
| 349 | 54.49 | 324 | 57.98 |
| 374 | 50.09 | 349 | 54.49 |
| 399 | 45.79 | 374 | 49.81 |
| 424 | 41.07 | 399 | 47.51 |
| 449 | 36.36 | 424 | 43.89 |
| 467 | 33.04 | 467 | 36.93 |
| 488 | 30.04 | 488 | 31.95 |
| 508 | 27.28 | 508 | 24.62 |

TABLE I-continued

| Cation Resin | | | |
|---|---|---|---|
| Example 1 | | Comparative Example C-1* | |
| Volume of Sweet-Water (ml) | Grams D.S./100 ml | Volume of Sweet-Water (ml) | Grams D.S./100 ml |
| 528 | 24.50 | 528 | 18.65 |
| 548 | 21.62 | 548 | 13.99 |
| 568 | 18.61 | 568 | 10.49 |
| 587 | 12.01 | 587 | 7.97 |
| 607 | 6.50 | 607 | 6.06 |
| 627 | 3.75 | 627 | 4.62 |
| 647 | 2.06 | 647 | 3.38 |
| 667 | 1.15 | 667 | 2.45 |
| 686 | 0.65 | 686 | 1.81 |
| 706 | 0.40 | 706 | 1.35 |
| 726 | 0.10 | 726 | 1.00 |
| 746 | 0.09 | 746 | 0.70 |
| 766 | 0.08 | 766 | 0.50 |
| 785 | 0.07 | 785 | 0.30 |
| 805 | 0.07 | 805 | 0.15 |
| — | — | 825 | 0.10 |
| — | — | 845 | 0.09 |
| — | — | 865 | 0.08 |
| — | — | 884 | 0.07 |
| — | — | 904 | 0.07 |

*Not an example of the invention.

EXAMPLE 2

700 mls of a macroporous weak base anion exchange resin (available as DOWEX TM 66, from The Dow Chemical Company) which had been screened to the following bead size distribution:

| Bead Diameter Range (μm) | | Volume % Resin of Invention |
|---|---|---|
| Min. | Max. | Example 2 |
| 250 | 297 | 0.0 |
| 297 | 325 | 0.0 |
| 325 | 350 | 0.0 |
| 350 | 400 | 2.7 |
| 400 | 420 | 3.7 |
| 420 | 450 | 12.5 |
| 450 | 475 | 13.3 |
| 475 | 500 | 14.6 |
| 500 | 540 | 24.0 |
| 540 | 595 | 24.1 |
| 595 | 707 | 5.1 |
| 707 | 2500 | 0.0 |
| AVERAGE DIAMETER (VOLUME MEAN: 510 μm | | |
| DIAMETER DISTRIBUTION: 88.5% ± 15% of mean | | |

was loaded into a 1 in. I.D. glass column system consisting of two 2 ft. long, water jacketed sections, coupled together. A third unjacketed 2 ft. long section is attached on top of the two 2 ft. columns to allow backwashing of the resin. The resin is used in the free base form.

The bed of resin is backwashed with D.I. water at room temperature at a flow rate sufficient to expand the bed by 50 percent of the settled height. This is done in order to remove any unwanted matter present in the bed and also to classify the beads by size. The backwashing is continued for about 30 minutes.

To insure complete conversion of the resin to the free base form, a minimum of 2 bed volumes of 1N sodium hydroxide is passed downflow through the resin for a period of about 60 minutes. After complete conversion, the resin is rinsed with a downward flow of D.I. water until the effluent water exhibits a pH of at least 9.

After the backwashing is accomplished the top unjacketed 61 cm portion of the column is removed and the column is capped with a glass fritted flow distributor.

One liter of degassed D.I. water is pumped downflow while the jacketed columns are being heated to a temperature of about 50° C. by circulating hot water through the column jackets.

One liter of refined 42 percent HFCS exhibiting a D.S. of 50 percent is passed downflow through the bed with a contact time of 2.5 hours. The resin bed is sweetened-off by passing degassed D.I. water downflow at 2 bed volumes/hr. During the sweetening-off process, the flow out of the column is monitored and samples of the effluent are collected at recorded intervals in a fraction collector. Each sample is analyzed for refractive index using an Abbe Mark II refractometer and the D.S. content is determined by industry standards from the refractive indices. The results are reported in Table 2 under Example 2.

A plot of the D.S. concentrations versus the volume of water used to sweeten-off the sugar solution from the resin bed may be made and the areas under the curves integrated by known means. The integration results give a measure of the total amount of dissolved solids in the collected samples. From this value can be calculated the amount of water which must be removed from the total volume of liquid collected in order to return the collected sample to the original D.S. level of the 42 percent HFCS. This value is then used for comparison purposes to illustrate how much water must be evaporated from the sweet-water when an ion exchange resin which does not exhibit a uniform size distribution is used.

The results are summarized in Table 3 under Example 2.

COMPARATIVE EXAMPLE 2

The method of Example 2 was essentially repeated except that the weak-base anion exchange resin (available as DOWEX TM 66 from The Dow Chemical Company) used to demineralize the HFCS had the following bead size distribution:

| Bead Diameter Range (μm) | | Volume % Example C-2 |
|---|---|---|
| Min. | Max. | DOWEX TM 66 |
| 150 | 250 | 0.0 |
| 250 | 297 | 0.4 |
| 297 | 354 | 2.5 |
| 354 | 420 | 5.9 |
| 420 | 500 | 10.5 |
| 500 | 595 | 16.9 |
| 595 | 707 | 24.3 |
| 707 | 841 | 22.2 |
| 841 | 1000 | 17.3 |
| 1000 | 1190 | 0.0 |
| 1190 | 2000 | 0.0 |
| 2000 | 2500 | 0.0 |
| AVERAGE DIAMETER (VOLUME MEAN): 660 μn | | |
| DIAMETER DISTRIBUTION: 63.4% ± 15% of mean | | |

The results are summarized in Tables 2 and 3 under Example C-2.

TABLE II

| Anion Exchange Resin | | | |
|---|---|---|---|
| Example 2 | | Comparative Example C-2* | |
| Volume of Sweet-Water (ml) | Grams D.S./100 ml | Volume of Sweet-Water (ml) | Grams D.S./100 ml |
| 230.3 | 59.85 | 266.6 | 58.90 |

TABLE II-continued

| Anion Exchange Resin | | | |
|---|---|---|---|
| Example 2 | | Comparative Example C-2* | |
| Volume of Sweet-Water (ml) | Grams D.S./100 ml | Volume of Sweet-Water (ml) | Grams D.S./100 ml |
| 260.0 | 57.94 | 286.4 | 57.05 |
| 279.8 | 55.05 | 306.2 | 54.63 |
| 299.6 | 53.10 | 326.0 | 52.60 |
| 319.4 | 50.10 | 345.8 | 49.60 |
| 339.2 | 46.77 | 365.6 | 46.61 |
| 359.0 | 43.28 | 385.4 | 44.15 |
| 378.8 | 39.74 | 405.2 | 41.25 |
| 398.6 | 36.20 | 425.0 | 38.15 |
| 418.4 | 33.17 | 444.8 | 34.95 |
| 438.2 | 30.30 | 464.6 | 28.85 |
| 458.0 | 28.28 | 484.4 | 22.43 |
| 477.8 | 25.06 | 504.2 | 17.93 |
| 497.6 | 17.15 | 524.0 | 14.45 |
| 507.5 | 13.69 | 543.8 | 11.28 |
| 517.4 | 11.10 | 563.3 | 8.98 |
| 537.2 | 7.25 | 583.4 | 7.05 |
| 547.1 | 5.99 | 603.2 | 5.64 |
| 557.0 | 4.72 | 623.0 | 4.47 |
| 576.8 | 3.10 | 642.8 | 3.33 |
| 596.6 | 1.84 | 662.6 | 2.34 |
| 606.5 | 1.14 | 682.4 | 1.91 |
| 626.3 | 0.95 | 702.2 | 1.42 |
| 636.2 | 0.51 | 722.0 | 1.09 |
| 656.0 | 0.16 | 741.8 | 0.80 |
| 675.8 | 0.10 | 761.6 | 0.70 |
| 696.6 | 0.16 | 781.4 | 0.50 |
| 774.8 | 0.00 | 801.2 | 0.50 |
| — | — | 821.0 | 0.38 |
| — | — | 860.6 | 0.30 |
| — | — | 880.4 | 0.38 |
| — | — | 930.4 | 0.00 |

*Not an example of the invention.

TABLE III

| Example | Volume of Water (ml) Which Must be Removed to Return to Original D.S. Level | Percent Reduction |
|---|---|---|
| 1 | 244 | 28 |
| C-1* | 341 | |
| 2 | 358 | 27 |
| C-2* | 485 | |

*Not an example of the present invention.

A comparison of the data indicates that when an ion exchange resin of the claimed bead diameter distribution is used, the amount of water which must be evaporated in order to return the sweet-water to a 50 percent dissolved solids level is reduced by a measurable amount (e.g., 28 percent) compared to the amount of water which must be evaporated from the sweet-water generated from sweetening-off the sugar solution from an ion exchange resin exhibiting a conventional bead diameter distribution. Therefore, the amount of water which needs to be evaporated within the sugar refining process is reduced.

EXAMPLE 3

Operating capacity data was obtained while demineralizing dextrose syrup in a full scale high fructose refining plant. In this plant the resins employed in Examples C-1 and C-2 were set up in sequence (175 cubic feet of each—4.96 cubic meters) and a parallel system employing the same volume of the same resins which had been screened to the following bead size distribution was set up:

| Bead Diameter Range (μm) Min. | Max. | Volume % Cation Resin of Invention |
|---|---|---|
| 150 | 210 | 0.0 |
| 210 | 370 | 1.6 |
| 370 | 420 | 3.7 |
| 420 | 470 | 10.2 |
| 470 | 500 | 12.7 |
| 500 | 525 | 17.0 |
| 525 | 550 | 18.5 |
| 550 | 575 | 18.6 |
| 575 | 600 | 11.8 |
| 600 | 625 | 5.9 |
| 625 | 650 | 0.0 |
| 650 | 2500 | 0.0 |
| AVERAGE DIAMETER (VOLUME MEAN): 523 μm | | |
| DIAMETER DISTRIBUTION: 88.8% ± 15% of mean | | |

| | | Volume % Anion Resin of Invention |
|---|---|---|
| 250 | 297 | 0.2 |
| 297 | 354 | 1.5 |
| 354 | 380 | 2.2 |
| 380 | 400 | 3.2 |
| 400 | 420 | 4.8 |
| 420 | 460 | 17.2 |
| 460 | 480 | 16.8 |
| 480 | 500 | 14.7 |
| 500 | 525 | 16.8 |
| 525 | 550 | 13.3 |
| 550 | 595 | 9.2 |
| 595 | 2500 | 0.0 |
| AVERAGE DIAMETER (VOLUME MEAN): 483 μm | | |
| DIAMETER DISTRIBUTION: 92.8% ± 15% of mean | | |

Operating capacities were measured as volumes of dextrose syrup demineralized per cycle with cycles alternating between conventional resins and resins of the invention. The resins were regenerated back to usable form each cycle. The results are shown in the following Table IV.

TABLE IV

| Test Period | Average Gallons of Syrup Treated Per Cycle: Conventional Resin | Resin of Invention | Percent Increase in Operating Capacity |
|---|---|---|---|
| A | 123,128 | 136,790 | 11 |
| B | 118,840 | 133,350 | 12 |
| C | 113,842 | 129,077 | 13 |
| D | 109,686 | 124,160 | 13 |

The resins employed in the present invention show from 11 to 13 percent improvement in operating capacity over the conventional resins when operating as a two-bed unit process (cation resin followed by anion resin in a single pass).

What is claimed is:

1. An improved process for demineralizing a sugar-containing solution of ionic impurities by contacting the solution with an ion exchange resin capable of retaining the ionic impurities upon contact with the sugar-containing solution, the improvement comprising using the ion exchange resin in bead form wherein the volume average diameter of the beads is from 400 to 700 μm and which resin exhibits a bead diameter distribution such that at least 85 volume percent of the beads have diameters which fall within a range of ±15 percent of the volume average diameter of the resin used.

2. The process of claim 1 wherein the bead diameter distribution is such that at least 90 volume percent of the beads exhibit diameters which fall within a range of ±15 percent of the volume average diameter of the ion exchange resin.

3. The process of claim 1 wherein the volume average diameter of the ion exchange resin ranges from 500 μm to 600 μm.

4. The process of any one of claims 2 or 3 wherein the ion exchange resin is a macroporous strongly acidic cation exchange resin, a macroporous weakly basic anion exchange resin, or a macroporous strongly basic anion exchange resin.

5. The process of claim 4 wherein the ion exchange resin comprises a copolymer of styrene and divinylbenzene.

6. The process of claim 5 wherein the sugar-containing solution is a solution comprising high fructose corn syrup.

7. An improved process for demineralizing a sugar-containing solution of ionic impurities by contacting the solution with an ion exchange resin capable of retaining the ionic impurities upon contact with the sugar-containing solution, the improvement comprising using the ion exchange resin in bead form wherein the volume average diameter of the beads is from 400 to 700 μm and which resin exhibits a bead diameter distribution such that at least 85 volume percent of the beads have diameters which fall within a range of ±15 percent of the volume average diameter of the resin used, the ion exchange resin exhibiting improved operating performance when compared to an otherwise similar conventional ion exchange resin that does not meet the volume average diameter and the bead diameter distribution requirements, the improved operating performance comprising (1) an increased operating capacity for removal of the ionic impurities and (2) production of a reduced amount of sweet-water during resin regeneration.

* * * * *

US005094694A

REEXAMINATION CERTIFICATE (2622nd)

United States Patent [19]

[11] B1 5,094,694

LaBrie et al.

[45] Certificate Issued Jul. 11, 1995

[54] PROCESS FOR DEMINERALIZING A SUGAR-CONTAINING SOLUTION

[75] Inventors: Robert L. LaBrie; Upen J. Bharwada, both of Midland, Mich.

[73] Assignee: The Dow Chemical Company, Midland, Mich.

Reexamination Requests:
No. 90/002,764, Jun. 29, 1992
No. 90/003,269, Dec. 6, 1993

Reexamination Certificate for:

| | |
|---|---|
| Patent No.: | **5,094,694** |
| Issued: | **Mar. 10, 1992** |
| Appl. No.: | **668,395** |
| Filed: | **Mar. 13, 1991** |

Related U.S. Application Data

[63] Continuation of Ser. No. 183,417, Apr. 18, 1988, abandoned, which is a continuation-in-part of Ser. No. 32,847, Mar. 31, 1987, abandoned.

[51] Int. Cl.[6] ..... C13D 3/14

[52] U.S. Cl. ..... 127/46.2; 426/271; 210/660; 210/670

[58] Field of Search ..... 127/46.2, 46.1, 46.3; 426/271; 210/660, 670

[56] References Cited

U.S. PATENT DOCUMENTS

| | | | |
|---|---|---|---|
| 4,247,340 | 1/1981 | Cartier | 127/48 |
| 4,444,961 | 4/1984 | Timm | 526/88 |
| 4,523,950 | 6/1985 | Otte | 127/46.2 |

OTHER PUBLICATIONS

R. Byron Bird et al., Transport Phenomena, John Wiley & Sons, Inc. (1960), pp. 40–41, 198–201.

Kunin, Ion Exchange Resins, 2nd Ed., 1958, pp. 52, 81–82, 321–322, 331–333, 336.

Dorfner, Ion Exchangers, 1972, pp. 12–13, 28–32, 56–57.

Dow Brochure: With high performance Dowex Monosphere Resins, 1984, p. 6.

Rohm & Haas brochure: "Deionization with Amberlite ion exchange resins in Monobed ion exchange systems", 15 pages publ Apr. 1974.

Rohm & Haas brochure: "Ion exchange with the Amberlite resins", pp. 1–5, 1974.

P. M. Lange and F. Martinola (Bayer AG): Monodisperse Ion Exchangers and Adsorbents, Journal: Vom Wasser, vol. 69, 1987, pp. 208–215.

Albright et al., *Encyclopedia of Polymer Science and Engineering,* vol. 8, pp. 341–393 (1987) (no month avail.).

Dow, Dowex Monosphere technical leaflet (1983) (no month avail.).

Prentiss et al., *Proceedings of the 43rd International Water Conference,* "Evalutation of Uniform Mesh Ion Exchange Resins for Condensate Polishing," vol. 43, Pittsburgh, Pa., 1984, pp. 179–189 (no month avail.).

*Primary Examiner*—David M. Brunsman

[57] ABSTRACT

Improved method for demineralizing a sugar-containing solution using an ion exchange resin in bead form wherein the volume average bead diameter is from 400 to 700 μm and the bead diameter distribution is such that at least 80 volume percent of the beads have diameters which fall within a range of ±15 percent of the volume average diameter of the resin used.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *